US009579668B2

(12) United States Patent
Morgan et al.

(10) Patent No.: US 9,579,668 B2
(45) Date of Patent: Feb. 28, 2017

(54) SPRAY NOZZLE SEALS

(75) Inventors: Sean Morgan, Mentone (AU); Stuart Morgan, Mentone (AU)

(73) Assignee: Spray Nozzle Engineering Pty Limited, Mentone, Victoria (AU)

( * ) Notice: Subject to any disclaimer, the term of this patent is extended or adjusted under 35 U.S.C. 154(b) by 37 days.

(21) Appl. No.: 13/990,708

(22) PCT Filed: Nov. 30, 2011

(86) PCT No.: PCT/AU2011/001552

§ 371 (c)(1),
(2), (4) Date: Nov. 4, 2013

(87) PCT Pub. No.: WO2012/071613

PCT Pub. Date: Jun. 7, 2012

(65) Prior Publication Data

US 2014/0048630 A1 Feb. 20, 2014

(30) Foreign Application Priority Data

Nov. 30, 2010 (AU) ..... 2010905264

(51) Int. Cl.
*B05B 1/00* (2006.01)
*B05B 1/34* (2006.01)
*B05B 1/30* (2006.01)

(52) U.S. Cl.
CPC ..... *B05B 1/34* (2013.01); *B05B 1/3006* (2013.01); *B05B 1/341* (2013.01)

(58) Field of Classification Search
CPC ..... B05B 1/3006; B05B 1/34; B05B 1/341
(Continued)

(56) References Cited

U.S. PATENT DOCUMENTS 5,890,658 A * 4/1999 Caminada ..... B05B 1/3006 239/533.2
6,666,386 B1 * 12/2003 Huang ..... 239/463
(Continued)

FOREIGN PATENT DOCUMENTS

WO WO 2012071613 A1 6/2012

OTHER PUBLICATIONS

PCT International Search Report, PCT/AU2011/001552, dated Feb. 10, 2012.

(Continued)

*Primary Examiner* — Jason Boeckmann
(74) *Attorney, Agent, or Firm* — TraskBritt, P.C.

(57) ABSTRACT

A spray nozzle assembly (10) comprising a cap (30) which houses an inner assembly of nozzle inserts (40). The cap (30) is threadably engaged by complementary threads (31, 21) to a nozzle body (20). The nozzle body (20) and the cap (30) are therefore able to be mated in a controllable axially compressive relationship in which the threadable connection enables a large amount of finely controlled axial tensile or compressive force to be applied in either moving the cap (30) and nozzle body towards each other or away. It should be noted, however, that seat (70) restrict the extent of axial travel of the screwable parts (20, 30, 40) relative to and towards each other. This facility enables strong unwanted adhesive forces of glue-like or set flowable material to be broken so that the cap (30), insert assembly (40) and nozzle body (20) can be moved apart for servicing.

3 Claims, 2 Drawing Sheets

(58) Field of Classification Search
USPC .... 239/589, 590, DIG. 4; 277/630, 637, 648
See application file for complete search history.

(56) References Cited

U.S. PATENT DOCUMENTS

| | | | | |
|---|---|---|---|---|
| 6,918,512 | B2 | 7/2005 | Kondoh | |
| 9,027,860 | B2 * | 5/2015 | Morgan | B05B 1/3426 239/590 |
| 2007/0262173 | A1 | 11/2007 | Percival et al. | |
| 2008/0217435 | A1 * | 9/2008 | Whittaker et al. | 239/468 |
| 2009/0308953 | A1 * | 12/2009 | Palestrant et al. | 239/461 |

OTHER PUBLICATIONS

PCT Written Opinion, PCT/AU2011/001552, dated Feb. 8, 2012.
First CN Office Action; 201180066275.X; dated Jun. 16, 2015; 3 pgs; and English translation 5 pgs.

* cited by examiner

SPRAY NOZZLE SEALS

FIELD OF INVENTION

This invention relates to spray nozzle assemblies. More particularly, this invention relates to interior spray nozzle seals.

BACKGROUND TO THE INVENTION

The following description of the prior art is not intended to be, nor should it be interpreted as, an indication of the common general knowledge pertaining to the invention, but rather to assist the person skilled in the art in understanding the developmental process which led to the invention.

Spray nozzles have been described having a nozzle body extending from a fluid inlet end to a fluid outlet end. The interior of the nozzle body forms a housing defining a central bore extending through one or more counterbores and/or chambers. The nozzle body may receive a nozzle cap to retain the inserted devices. The nozzle cap may house various inserted flow modification devices, such as a swirl chamber, an orifice disc and the like.

In prior art devices, the outlet (the face proximal to the outlet) of an orifice disc has been described as abutting a landing defined by a peripheral flange of a nozzle cap extending radially inwardly towards the central bore axis. A flat washer compression seal can be provided between orifice disc and the nozzle cap. Such washer seals, however, do not provide for particularly reliable sealing at elevated pressures and temperatures. Particularly deleteriously, the flat seal may be squeezed out from its mating surfaces and, worse, may enter the material flow.

An O-ring seal groove arrangement has been described in which the groove is situated in a lower peripheral flange of the nozzle cap. This arrangement may conform to sealing gland dimension standards and provide satisfactory sealing between the orifice disc and nozzle cap. However, this arrangement requires that the wall thickness between be the base of the groove and the outer nozzle cap surface be reduced, taking into account other design constraints such as the need to provide an outer nozzle profile that does not impede the spray pattern emitted from the orifice disc. Accordingly, this arrangement compromises the mechanical strength of the nozzle cap peripheral flange, a critical structural element in a spray nozzle arrangement. In such arrangements, the nozzle cap has an O-ring groove and the orifice disc abuts the peripheral flange of the nozzle cap inboard of the O-ring groove. The outer periphery of the orifice disc is free and unsupported at the outer O-ring groove. The orifice disc outer diameter is smaller than the accommodating internal diameter of the nozzle body chamber housing same to provide clearance and facilitate service and removal of the orifice disc—the internal components and elements of the nozzle body may be gummed up by hard-dried or set flow material and suitable clearance in prior art arrangements between the orifice disc and the nozzle cap chamber is generally required. Furthermore, this arrangement provides little mechanical support for the compressive forces required to create an adequate seal face to face without gaps. The arrangement is therefore less than ideal for high pressure operations.

Accordingly, arrangements have been described in which an O-ring groove has not been included in the nozzle cap for the proper sealing of the parts and sealing member is simply provided in a compression arrangement in the manner of a flat washer or gasket. Instead a gap is included as a design feature between the orifice disc and the nozzle cap in the fully assembled spray nozzle. Such an arrangement is not suitable for high pressure applications.

Accordingly, an object of the invention is to overcome one or more of the disadvantages encountered in previously described spray nozzle arrangements or to at least provide a useful alternative thereto.

OUTLINE OF INVENTION

Accordingly, in one aspect of the invention there is provided a sealing means in a spray nozzle assembly including a groove adapted to at least partially accommodate a compressible sealing material in an upper face of an insert in the nozzle assembly, the upper disc face together with the sealing material adapted to sealingly engage with a downwardly facing surface of the nozzle assembly in which the downwardly facing surface is compressed towards the upper insert face.

In another aspect of the invention, there is provided:

An insert for a spray nozzle assembly, the spray nozzle assembly comprising a nozzle cap, wherein an upper face of the insert includes a recess for receiving or locating a seal that is adapted to abut a downwardly facing surface of the nozzle assembly; and the nozzle cap is adapted to compress towards the insert to compress the seal in the recess and against the downwardly facing surface.

The insert may be a variety of geometric shapes adapted to perform various material flow modification functions within the spray nozzle assembly. The insert may be a solid or hollow rectangular block, disc or cylinder. The axial bore may extend diagonally relative to the insert longitudinal axis (which may generally correspond to the spray nozzle assembly longitudinal axis), or may be parallel or concentric thereto. Preferably the axial bore is a flow material aperture. Preferably the axial bore is a flow material orifice. The insert may be an orifice disc, swirl chamber, orifice shield, or a combination of two or more of the aforementioned. Preferably, the insert is an orifice disc. The insert may be generally cylindrical, optionally with radiused or bevelled edges, for example to facilitate self-alignment and location in the insert retainer. The recess extends around an axial bore and is radially spaced therefrom The spray nozzle assembly may further comprise an insert retainer adapted to house the insert. The nozzle cap may be adapted to compress towards the insert retainer to compress the seal in the recess and against the downwardly facing surface.

The insert retainer may be a hollow housing or a frame. The insert retainer may be adapted to receive the insert or to otherwise secure the insert against relative movement prior to insertion into the nozzle assembly.

The downwardly facing surface may be a lower surface of another insert or an inner surface of the nozzle cap.

The recess may be a groove. The recess is preferably a circular groove. The circular groove is preferably concentric with a nozzle body central axis. The recess may include many different profiles to accommodate a variety of different types of seals. Although an O-ring in may applications is particularly preferred, other seal cross-sections are envisaged. Furthermore, the cross-sectional shape of the recess may include a rectangular, channel shaped groove, optionally with rounded or radiused corners. Rounded corners may confer functional advantages, particularly in accommodating seal squeeze (distortion, for example from a toroidal shape, on compression), and dispersing stress concentrations around the corners to extend the life of the insert. The recess is preferably a circular groove having a rectangular cross-section with radiused corners and a cross-sectional area greater than the cross-sectional area of the seal whilst allowing sufficient squeeze to provide an effective seal.

In yet another aspect of the invention, there is provided a sealing system for a spray nozzle having a nozzle body engageable to the insert retainer in which a secondary seal between the nozzle cap and an insert in the insert retainer is independent of a secondary seal between a nozzle body and the nozzle cap.

Whereas the prior art may use a radially compressed body seal or a flat washer or gasket seal, the pressure containing function of the present invention may be performed by the use of two independent seals, a primary and a secondary seal.

These two independent seals operate under compression to perform the pressure containing function for the entire nozzle assembly, whereby the primary seal resides at the front of the assembly within the nozzle cap, and provides a seal between the insert, preferably the orifice disc, and the nozzle cap, and the secondary seal is located at the rear sealing face of the nozzle cap.

It is preferred that the compressive forces on the seals are axial in nature. For example, the nozzle body and nozzle cap may be threadably engaged by screwing these components together in an axial direction whereby to effect axial compression on the seals.

As the nozzle cap and the insert retainer may be engageable by means of an inner threaded screw mechanism for axial movement relative thereto, and the nozzle cap and nozzle body may be engageable by means of an outer threaded screw mechanism for axial movement relative thereto, the primary and secondary seals may perform respective axially compressive sealing functions independently of one another.

The rear sealing face may engage the nozzle body via an outer threaded engagement, such as screw mechanism, to effect controlled axial compression in the secondary seal.

In a particularly preferred form of the Invention, the spray nozzle assembly includes the nozzle cap, a nozzle body and the insert retainer, the nozzle assembly having:

the seal constituting a primary seal within the insert that abuts the downwardly facing surface which compressively seals when the insert retainer is fastened to the nozzle cap, a secondary seal which is located between a lower face of the lower periphery of the nozzle cap and a seat, the seat presenting an upwardly facing surface of the nozzle body and is held compressively by the nozzle cap when assembled; and such that each of the primary and secondary seals is positively located and compressed in its position independently of the other.

It is preferred that the seals are O rings, although seals of other shapes, such as cross-sectionally ovaloid or rectangular, may be suitably employed in the invention.

It is preferred that the secondary seal means be an O ring located in position by the provision of at least one skirt device extending between the lower periphery of the nozzle cap and the nozzle body seat.

Although the opposite orientation is envisaged as falling within the scope of the invention, it is preferred that the secondary O ring be located in position over the nozzle body seat by the lower end of a skirt depending from an outlet end of the nozzle cap. The secondary seal may therefore be located in position by the provision of the at least one skirt device extending from the lower periphery of the nozzle cap and may axially overlap the nozzle body seat when the nozzle assembly is assembled.

It is also preferred that the nozzle cap skirt has an inner wall and an outer wall that define a circular skirt groove facing downwardly towards a circular seat of the nozzle body, the seat preferably adapted to compress the secondary seal located in the skirt groove.

It is also preferred that an inner and an outer skirt device define an aperture in the lower periphery of the nozzle cap.

It is further preferred that these skirt devices extend into annular mating grooves on either side of the nozzle body seat.

It is also preferred that these grooves provide sufficient room about the skirts such that minor damage to the skirts does not compromise the seal.

It is further preferred that the skirts be stepped such that a flat portion can abut each side of the seat while a portion is accommodated in its groove.

BRIEF DESCRIPTION OF THE DRAWING FIGURE

The systems and arrangements made according to the invention may involve design variations as described below. The preferred embodiments of the invention may be better understood from the following non-limiting description, in which.

DESCRIPTION OF AN EMBODIMENT OF THE INVENTION

Figure 1:
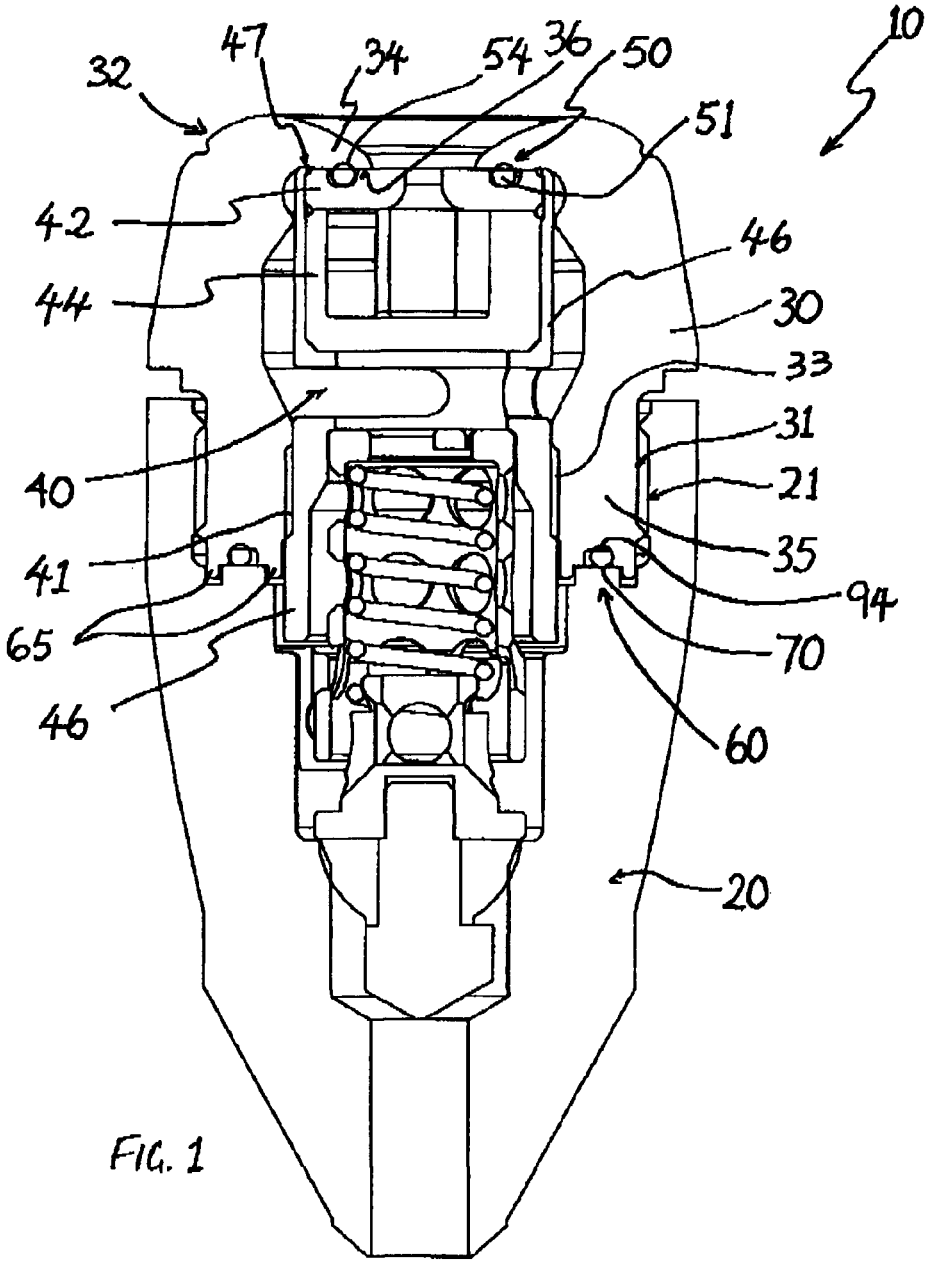
FIG. 1 is a cross section of a spray nozzle according to one embodiment of the invention.

Referring to FIG. 1, a spray nozzle assembly 10 is shown which consists of a cap 30 which houses an inner assembly of nozzle inserts 40. The cap 30 is threadably engaged by complementary threads 31, 21 to a nozzle body 20. In one form of the invention, the nozzle body 20 may be a lance adapter. The nozzle body 20 and the cap 30 are therefore able to be mated in a controllable axially compressive relationship in which the threadable connection enables a large amount of finely controlled axial tensile or compressive force to be applied in either moving the cap 30 and nozzle body 20 towards each other or away. It should be noted, however, that seats 70 restrict the extent of axial travel of the screwable parts 20, 30, 40 relative to and towards each other. This facility enables strong unwanted adhesive forces of glue-like or set flowable material to be broken so that the cap 30, insert assembly 40 and nozzle body 20 can be moved apart for servicing because large amounts of torque may be applied to, for example, the insert retainer 40 by a spanner or other wrench like tool utilising the screw mechanism.

As the skilled person will appreciate, the insert assembly 40 may be described in the spray nozzle industry as an insert retainer, nozzle interior, insert pin or screw pin.

The inner assembly 40 includes an orifice disc 42 axially aligned and atop a swirl chamber 44 that is seated in an insert housing 46, such as that described in the Applicant's Australian patent application No. 2011244841, the entire contents of which are incorporated herein by reference.

A second seal 60 is located between the nozzle body 20 and the cap 30 and a first seal 50 is located between the cap 30 and the insert assembly 40. The second seal 60 is therefore independent of the first seal 50.

More particularly, the first seal 50 is located between the orifice disc 42 and the inner cap housing 32 formed from a radially inwardly extending upper flange 34 that overhangs the insert assembly 40 in use. The insert housing 46 comprises a threaded generally hollow cylindrical body (screw pin) with an externally threaded cylindrical wall 41 adapted to mate with a corresponding internally facing thread 33 in a lower cap wall 35. The insert housing 46 includes a retaining clasp 47 that is adapted to hold the swirl chamber 44 and orifice disc 42 in place. All seals 50, 60 are axially compressive, that is axially compressed to form a high pressure seal.

The first and second seals 50, 60 are positively located in their respective positions and are compressed independently of the other. The first seal 50 may first be compressed into place by screwing the insert housing 46 into the nozzle cap 30. The second seal 60 may then be compressed into place by the threadable engagement of the cap 30 into the nozzle body 20. The amount of torque applied to the respective threaded connections is not critical as the seals 50, 60 are housed in grooves 56, 66 and the extent of threaded connection is limited by seal seat 70 as described below.

Although any appropriate seal means may be used in the invention, it is preferred that the O rings 50, 60 be used.

The seals 50, 60 are arranged such that the front seal 50 and rear seal 60 are respectively held within two independent and unique housing arrangements, each consisting of two specially designed mating parts that, when compressively held together, form respective closed, substantially semi-toroidal or grooves or channels with radiused corners 56, 66 to contain the seals 50, 60 in respective seal housing cavities that then conform to sealing groove conventions. In addition, the second seal 60 includes a protective double annular skirt 65 arrangement that extends beyond the sealing face of the nozzle cap 30 face.

The second O-ring 61 is located in position by the provision of the skirt device 65 extending between the lower periphery 35 of the nozzle cap 30 and a nozzle body seat 70 adapted to axially press against the O-ring 61.

Although the reverse orientation (in which protective skirts equivalent to skirts 654*a,b* are located on the nozzle body 20 and the lower periphery 35 includes a seat corresponding to the annular ridge 70) is envisaged as being included in the scope of the invention, the orientation described herein is convenient for retaining parts of the spray nozzle assembly in place when being opened, noting that the nozzle 10 may be held in an inverted orientation for disassembly.

In the embodiment described, the second O-ring 60 is located in position over the seat or annular ridge 70, guided by the side skirt devices 65 depending from the lower periphery 35 of the nozzle cap 30. The side skirt devices 65 comprise an inner annular skirt 65*a* and an outer annular skirt 65*b*.

These inner and an outer skirt devices 65*a,b* define apertures 90 including a first outer wide annular channel 91 and a second narrower channel 92, the narrower channel 92 stepped from the first channel 91. The channels 91, 92 are formed in the lower periphery 35 of the nozzle cap 30. The lower periphery 35 is in the form of a generally cylindrical large skirt depending downwardly from the upper flange 34. The inner and outer skirts 65*a,b* extend downwardly from the bottom of the lower peripheral skirt 35 and, indeed, form the lower-most portions of the lower peripheral skirt 35. The first channel 91 provides an annular mating groove between the dual skirts 65*a,b*, so that when the spray nozzle 10 is assembled, the skirts 65*a,b* extend either side of the nozzle body ridge seat 70. The transition from the wider first annular groove 91 to the narrower, deeper groove 92 is effected by shoulders or steps 93. The steps 93 in turn provide seat surfaces for the inner and outer upwardly facing surfaces of the upwardly extending annular ridge 70.

The grooves 91, 92 are dimensioned or over-sized relative to the ridge seat 70 to provide sufficient room within the skirts 65*a,b* such that minor damage to the skirts 65*a,b* when assembling or disassembling the does not compromise the seal 60.

It can be seen that the skirts 65 are stepped such that the flat shoulder portions 93 (refer to a slightly different embodiment in FIG. 3 not showing shallow grooves 54, 94 of FIG. 1) can abut each side of the ridge seat 70 while an upper portion of the O-ring 61 may extend into a shallow groove 94 at the upper end of the deep narrow groove 92.

The skirt 65 provides an independent protective element for the seal 60 abutting surfaces 70, 93, and is independent of the formed groove 92 that houses the O-ring 61 once the parts 20, 30 are mated. And the deep groove aperture 92 for the seal 60 is separate from the defined aperture or groove 91 between skirts 65*a,b* which are designed to protect the seal face of ridge 70 and steps 93 from impact damage during assembly and disassembly of the nozzle assembly 10.

An overall lance to which the spray nozzle assembly 10 may be attached in use may hang downward during handling and in typical installations, so that the preferred embodiment includes the seal groove 91, 92 being housed in an inverted cap 30 during assembly to prevent the O-ring 61 from falling out on assembly. However, reverse arrangement is possible in which grooves similar to grooves 91, 92 are formed in the upper portion of the nozzle body 20, the lower periphery of the cap skirt 35 having a downwardly depending ridge seat similar to the ridge seat 70.

In the embodiment shown in FIG. 1, the O-ring 51 is seated in the orifice disc 42 on one side and is received in a partial groove 54 formed in the inner surface of the cap flange 34.

The precise shape and presence of these grooves 91, 92 is not restricted in the invention. Neither is the shape of the skirts 65 which form aperture 90, and the seat 70, restricted in the invention, except to the extent that the seal 60 in the aperture 90 is positively located and forms an effective seal.

Figure 2:
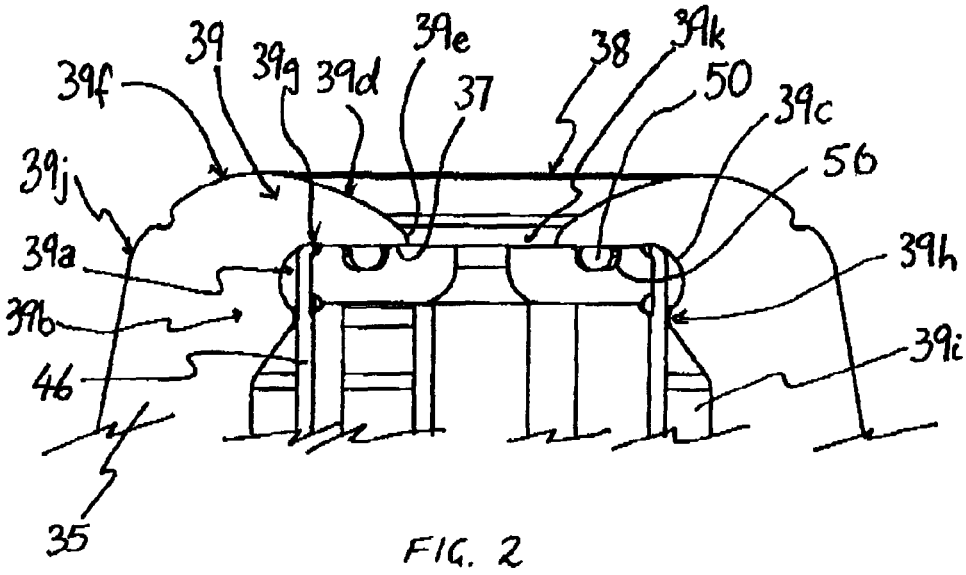
FIG. 2 is a sectional view of a portion of the nozzle assembly shown in FIG. 1 featuring a first seal.

Turning to FIG. 2, there is shown a slightly different arrangement in which the upper accommodating groove 54 shown in FIG. 1 formed in the downwardly facing surface 36 of the flange 34 is replaced with a flat surface 37 immediately above the location of the O-ring 51, that the O-ring 51 is compressed into a flatter form within the groove 56. For this purpose, the groove 56 has a greater width than the O-ring 51 when uncompressed to enable the O-ring 51 to squeeze or flatten into the cavity defined by the groove 56 and the downward flange surface 37 and effect a good pressure-resistant front seal 50.

The location of the O-ring 51 in the orifice disc 42 is particularly advantageous to for a number of reasons. One reason is to facilitate easy replacement of consumable parts by including these in the insert assembly 40, which includes other consumable parts in the orifice disc 42 and swirl chamber 44, and requiring less regular replacement, the insert housing 46. Generally, of all of the consumable parts, the O-rings 51, 61 are most regularly required to be replaced. Another related reason is that the seal 50 is critical and any damage or compromise thereto may require replacement. Accordingly, positioning the seal seat or groove 56 on a wear part means that such replacement involves minimal cost and disruption to operations.

Another reason is that, despite the prevailing wisdom prior to the invention was to include the seal groove in the nozzle cap, this imposes significant engineering and design constraints on the spray outlet 38 as the provision of a groove in the flange 34 wall means that the wall must be thickened to have the requisite strength (the flange 34 may be prone to fracturing or otherwise failing). Furthermore, it is desirable that there be a gap 39*a* provided between the insert housing 36 and the upper portion 39*b* of the skirt 35. For this purpose, the internal wall surface 39*c* is radiused to serve to functions: firstly, the curved surface 39*c* more evenly distributes and disperses stresses on that corner where the upper portion 39*b* and the flange 34 meet, allowing for a stronger corner structure. It will be noted that prior art seal seats and abutments have sharp angles thereby being less resistant to fracture or failure at the angled corner. The gap 39*a* allows for the easier removal of the insert assembly 40 from the nozzle cap 30 as set, dried and/or gluey residue from flow material is less able to bind the insert housing 46 to the cap 30. Against these design constraints, it will be appreciated that the outlet structure 39 should be as shallow and streamlined a structure as possible to minimise interference with the spray production, so that there are limitations on how the thick the flange 34 wall can be. The upper surface 39*d* of the flange 34 is profiled to have a steep curve close to 80°-90° at the outlet 38 opening to ensure that the flange 34 wall is sufficiently thick to have the requisite strength at its innermost edge 39*e*. The curve of the upper surface 39*d* transitions quickly to a flatter curve that as the flange radiates towards the flange shoulder 39*f* so that the upper surface 39*d* interferes with spray emanating from the orifice disc 42 orifice 43 to a minimal extent. The radiused gap 39*a* continues upwardly to a small and shallow peripheral groove 39*g* that is configured to accommodate the upper edge of the insert housing 46 and clasp 47 and curves downwardly to form a radially inwardly extending annular tongue 39*h* formed on the inner surface of the upper portion wall 39*b*. The tongue 39*h* provides a strengthening annular ridge for the wall 39*d* and also a tight-fitting guide for ensuring that the insert housing 46, although spaced from the wall 39*d* by the gap 39*a*, snugly fits in the nozzle chamber 39*i* defined by the flange 34 and skirt 35 and is not loosely fitted when the nozzle cap 30 and insert assembly 40 is assembled. The gap 39*a* lies axially intermediate the radial distance between the innermost edge 39*e* and the shoulder 39*f*. The lower surfaces 38, 38 radially extend inwardly about a third of the radial distance between the innermost edge 39*e* and the outer surface 39*j*. The radius of the gap 39*a* is 40-60% of the radius of the outlet 38 aperture 39*k*, about 30-50% of the radial length of the lower surface 36, 37 and about 40-60% of the height of the flange 34 taken from the top of the small groove 39*g* to the upper surface of the shoulder 39*f*.

One of the advantages of improved structure of the spray nozzle cap 30, with the seal 51 recessed in the insert 42, particularly with regard to the flange 34 structure, is the increased pressure rating of the nozzle cap 30.

Figure 3:
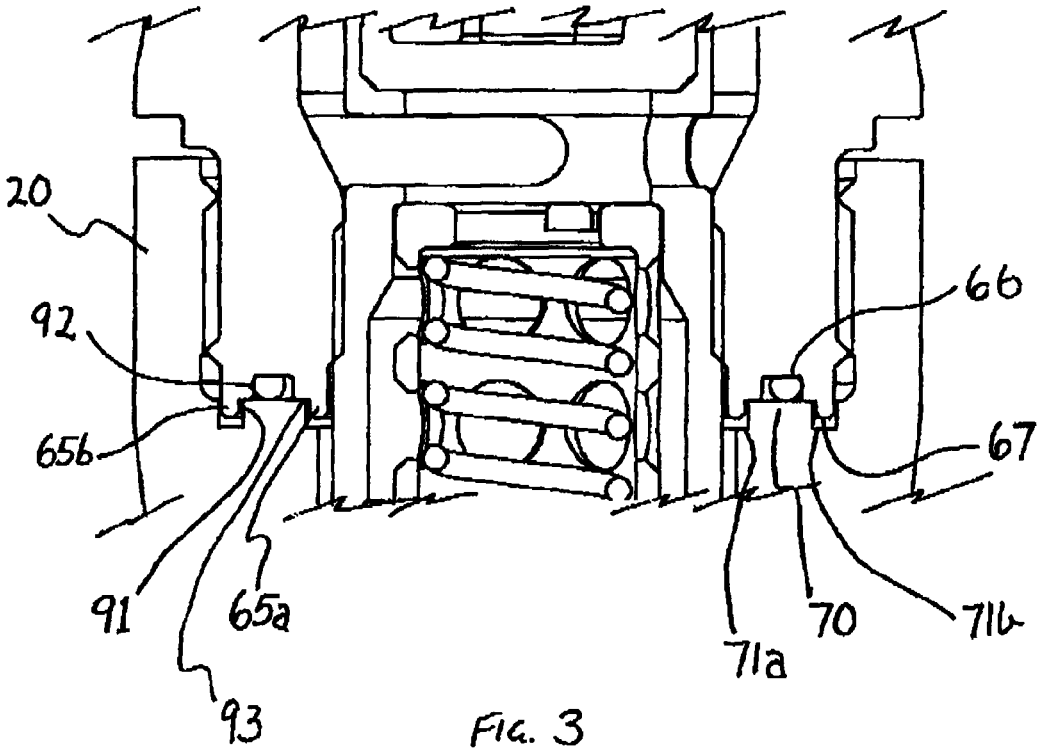
FIG. 3 is a sectional view of a portion of the nozzle assembly shown in FIG. 1 featuring a second seal.

With further reference to FIG. 3, the seal 60 is shown is greater detail with regard to a third embodiment in which the upper base of the deep groove 92 does not include a groove 94 (unlike the first embodiment of FIG. 1). The pair of annular, concentric skirts 65*a,b* straddle the ridge seat 70 and the steps 93 rest firmly of the ridge seat 70 when assembled. The downmost edges 67 of the skirt 65*a,b* walls partially occupy a pair of corresponding annular channels 71*a,b* defining the ridge seat 70, but the edges 67 do not reach the base of the channels 71*a,b*, to limit the abrasion or wear that they suffer. However, the purpose of the skirts 65*a,b* is to protect the seal 60 abutting surfaces. The channel 92 faces downward in the drawing and is opposed in orientation to the groove 56. In use, an operator will ensure that the O-ring 51, 61 rests in its respective groove 56 or channel 92 to ensure proper installation, noting that the O-ring 51, 61 will generally sit in its respective groove 56 or channel 92 against gravity due to a loose friction fit. The seals provide excellent axially compressed seals suitable for high pressure applications.

Figure 4:
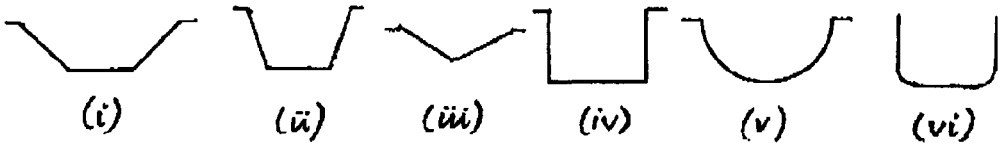
FIG. 4 schematically shows some alternative profiles of recesses that may be formed in the upper face of the insert or in other recesses accommodating seals according to the invention.

In FIG. 4 there is shown alternative groove 56, 66 cross-sectional profiles, noting that alternative (vi) is the profile shown in FIGS. 2 and 3.

While we have described herein one particular embodiment of the invention it is envisaged that variation and modifications of the features here described will lie within the spirit and scope of the invention.

Orientational terms used in the specification and claims such as vertical, horizontal, top, bottom, upper and lower are to be interpreted as relational and are based on the premise that the spray nozzle 10 will usually be considered in a particular orientation, typically with the nozzle cap 30 uppermost.

| Ref No. | Description | Ref No. | Description |
|---|---|---|---|
| 10 | Spray nozzle assembly, first embodiment | 11 | |
| 20 | Nozzle body | 21 | Nozzle body thread complementary to nozzle cap 31 |
| 30 | Nozzle cap | 31 | Nozzle cap thread complementary to nozzle body 21 |
| 32 | Inner cap housing | 33 | Internally facing cap thread |
| 34 | Radially inwardly extending upper flange | 35 | Lower cap wall; large skirt depending from flange 34 |
| 36 | Flange lower surface with groove 54 | 37 | Flat flange lower surface |
| 38 | Cap or nozzle outlet | 39 | Cap outlet structure |
| 39a | Gap | 39b | Upper portion of skirt 35 |
| 39c | Radiused or curved surface | 39d | Upper surface of flange 34 |
| 39e | Innermost edge of flange 34 | 39f | Flange shoulder |
| 39g | Peripheral groove | 39h | Annular tongue |
| 39i | Nozzle chamber | 39j | Outer cap surface |
| 40 | Insert assembly or insert retainer | 41 | Externally threaded cylindrical wall of insert housing 46 mates with cap thread 33 |
| 42 | Orifice disc | 43 | Orifice |
| 44 | Swirl chamber | 45 | |
| 46 | Insert housing | 47 | Retaining clasp of insert housing |
| 50 | First front O-ring seal | 51 | First front O-ring |
| 52 | | 53 | |
| 54 | Upper groove at base of groove 56 | 55 | |
| 56 | Annular groove in upper face of orifice disc 42 in which O-ring 50 is seated | | |
| 60 | Second rear O-ring seal | 61 | Second rear O-ring |

-continued

| Ref No. | Description | Ref No. | Description |
|---|---|---|---|
| 65a | Inner annular skirt | 65 | Double skirt arrangement or device |
| 66 | Annular groove in cap 30 in which O-ring 60 is seated | 65b | Outer annular skirt |
| 70 | Annular ridge seat | 67 | |
| 90 | Annular apertures | 71 | |
| 92 | Second narrower deeper channel | 91 | First outer wide annular channel |
| 94 | Upper groove at upper base of groove 92 | 93 | Shoulders or steps |

The invention claimed is:

1. A spray nozzle assembly comprising:

a nozzle body defining an upwardly facing annular ridge;

a first O-ring adapted to abut the upwardly facing annular ridge of the nozzle body; and a nozzle cap comprising an annular lower cap wall, the annular lower cap wall defining:

an inner annular skirt and an outer annular skirt, each extending downwardly from the annular lower cap wall;

an O-ring groove; and at least one step between the inner and outer skirts on each side of the O-ring groove;

wherein the nozzle cap and the nozzle body are configured to be mated in a controllable axially compressive relationship to cause the O-ring to form a seal between the annular lower cap wall and the upwardly facing annular ridge, wherein the annular ridge is configured to seat against the at least one step on each side of the O-ring groove.

2. The assembly of claim 1, wherein the O-ring groove comprises a circular channel.

3. The assembly of claim 1, wherein the spray nozzle assembly further comprises:

an insert within the nozzle cap; and a second O-ring configured to abut a surface of a radially inwardly extending flange of the nozzle cap and compressively seal the insert to the nozzle cap, wherein the second O-ring is configured to seal independently of the first O-ring.

* * * * *